US006418963B1

(12) United States Patent
Ekholm et al.

(10) Patent No.: US 6,418,963 B1
(45) Date of Patent: Jul. 16, 2002

(54) PIPE ATTACHMENT

(75) Inventors: Rolf Ekholm; Ulf Jansson, both of Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 0 days.

(21) Appl. No.: 09/554,285

(22) PCT Filed: Jul. 21, 1999

(86) PCT No.: PCT/SE98/02029

§ 371 (c)(1),
(2), (4) Date: Nov. 14, 1998

(87) PCT Pub. No.: WO99/26012

PCT Pub. Date: May 27, 1999

(30) Foreign Application Priority Data

Nov. 14, 1997 (FI) ..... 970501 U

(51) Int. Cl.[7] ..... E03B 5/00

(52) U.S. Cl. ..... 137/565.01; 137/561 A; 285/179; 162/246

(58) Field of Search ..... 137/565.01, 561 A; 285/179; 162/246

(56) References Cited

U.S. PATENT DOCUMENTS

| | | | | |
|---|---|---|---|---|
| 1,696,207 A | | 12/1928 | Larkin | |
| 2,547,567 A | | 4/1951 | Collison | |
| 2,990,710 A | * | 7/1961 | Burling | 68/181 |
| 4,043,049 A | * | 8/1977 | Hedstrom | 34/370 |
| 4,621,507 A | * | 11/1986 | Lundqvist | 68/181 R |
| 4,825,906 A | * | 5/1989 | Hartman | 137/625.3 |
| 5,201,553 A | | 4/1993 | Grisham | |

FOREIGN PATENT DOCUMENTS

| | | |
|---|---|---|
| FR | 2631682 | 11/1989 |
| GB | 524136 | 7/1940 |
| WO | WO 9739181 | 10/1997 |

* cited by examiner

*Primary Examiner*—A. Michael Chambers
(74) *Attorney, Agent, or Firm*—Fasth Law Offices; Rolf Fasth

(57) ABSTRACT

A pipe attachment comprises a pipe elbow that is tightly attached to a stand pipe so that the diameter of the stand pipe is greater than the diameter of the pipe elbow.

6 Claims, 4 Drawing Sheets

II-II

PIPE ATTACHMENT

FIELD OF THE INVENTION

The present invention relates to a pipe attachment, for example to a pulp pump, which attachment consists of a pipe bend and, joined tightly to the latter, a stand pipe.

TECHNICAL FIELD AND NEW SOLUTION

In order to obtain a uniform and stable discharge of pulp through a combination of stand pipe and pipe bend, it is important to ensure that the volume capacity of the said combination is sufficient. Of course, the rest of the structure must also be such that the flow and discharge of the pulp can proceed without disturbances, such as, for example, arching of the pulp.

According to the present invention, a smoother discharge is obtained by means of the fact that the diameter of the stand pipe is greater than that of the pipe bend.

The wall of the stand pipe preferably coincides with a wall portion of the pipe bend. The wall of the stand pipe preferably coincides with the internal curve wall of the pipe bend. Alternatively, the wall of the stand pipe can coincide with the external curve wall of the pipe bend or even the side walls of the pipe bend. It is essential that despite different diameters, the combination has a linearly coincident wall portion.

The diameter of the stand pipe can, for example, be 1.5 times the diameter of the pipe bend.

BRIEF DESCRIPTION OF THE DRAWINGS

The invention is described in greater detail with reference to the attached drawings in which.

DETAILED DESCRIPTION OF THE INVENTION

Figure 2:
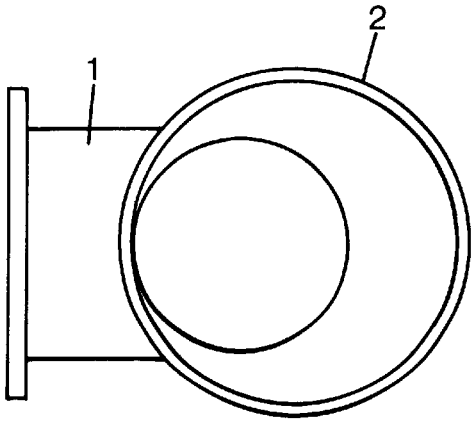
FIG. 2 shows a cross-section along the line II—II in FIG. 1.

The embodiment of the invention shown in the drawing consists of a stand pipe 2 with diameter 1.5×D. This stand pipe 2 is joined tightly to an underlying pipe bend 1 with diameter D. The free end of the pipe bend 1 is provided with an attachment flange.

The stand pipe 2 and the pipe bend 1 have been joined together so that the wall of the stand pipe 2 coincides linearly with the internal curve wall of the pipe bend 1. A contiguous wall portion as thereby obtained in the front wall of the combination. That end of the stand pipe 2 which has been joined to the pipe bend 1 has been provided with a bottom equipped with a hole, corresponding to the diameter of the pipe bend, above the pipe bend for attachment to the bend.

The advantage of the stand pipe having a greater diameter while retaining the same height is that a greater buffer capacity is obtained. This increased capacity affords a considerably more uniform discharge. The time between the maximum level and minimum level in the stand pipe increases in proportion to the difference in diameter. For example, if, in the arrangement according to the drawing, the diameter D of the bend is 800 mm, the diameter of the stand pipe is 1200 mm. The buffer capacity is thus 2.25 times greater than it would be if the diameter of the stand pipe were also to be 800 mm.

As can be seen from the drawing, the front wall portion of the stand pipe coincides with the internal curve wall of the pipe bend, and the two pipe portions are therefore not joined together coaxially. The even internal wall portion which is thus obtained guides the flow of the pulp and prevents the occurrence of arching. The same control is also obtained if the two pipe portions included in the combination are joined together so that the wall of the stand pipe coincides with the external curve wall of the pipe bend or any of its side walls.

Figure 1:
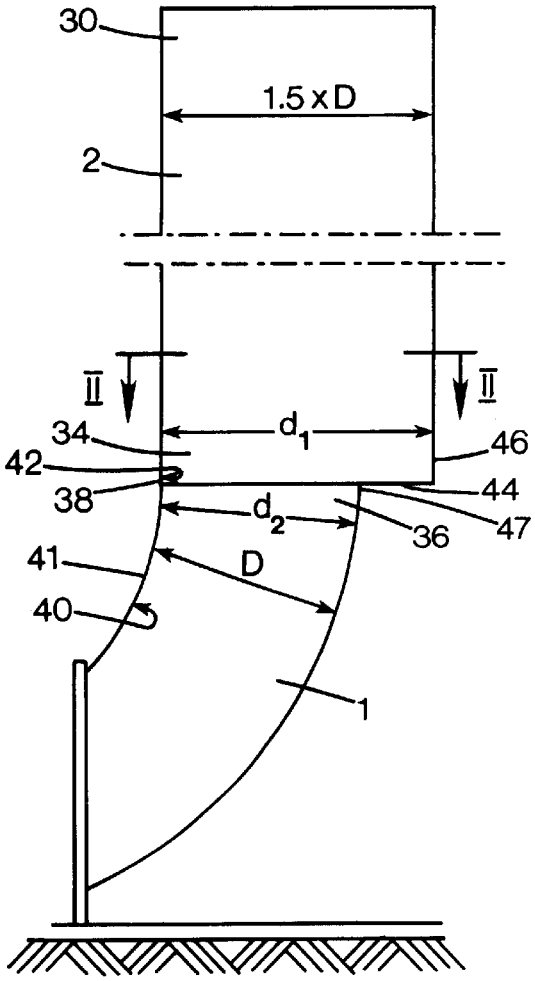
FIG. 1 shows a side view of the invention.
Figure 3:
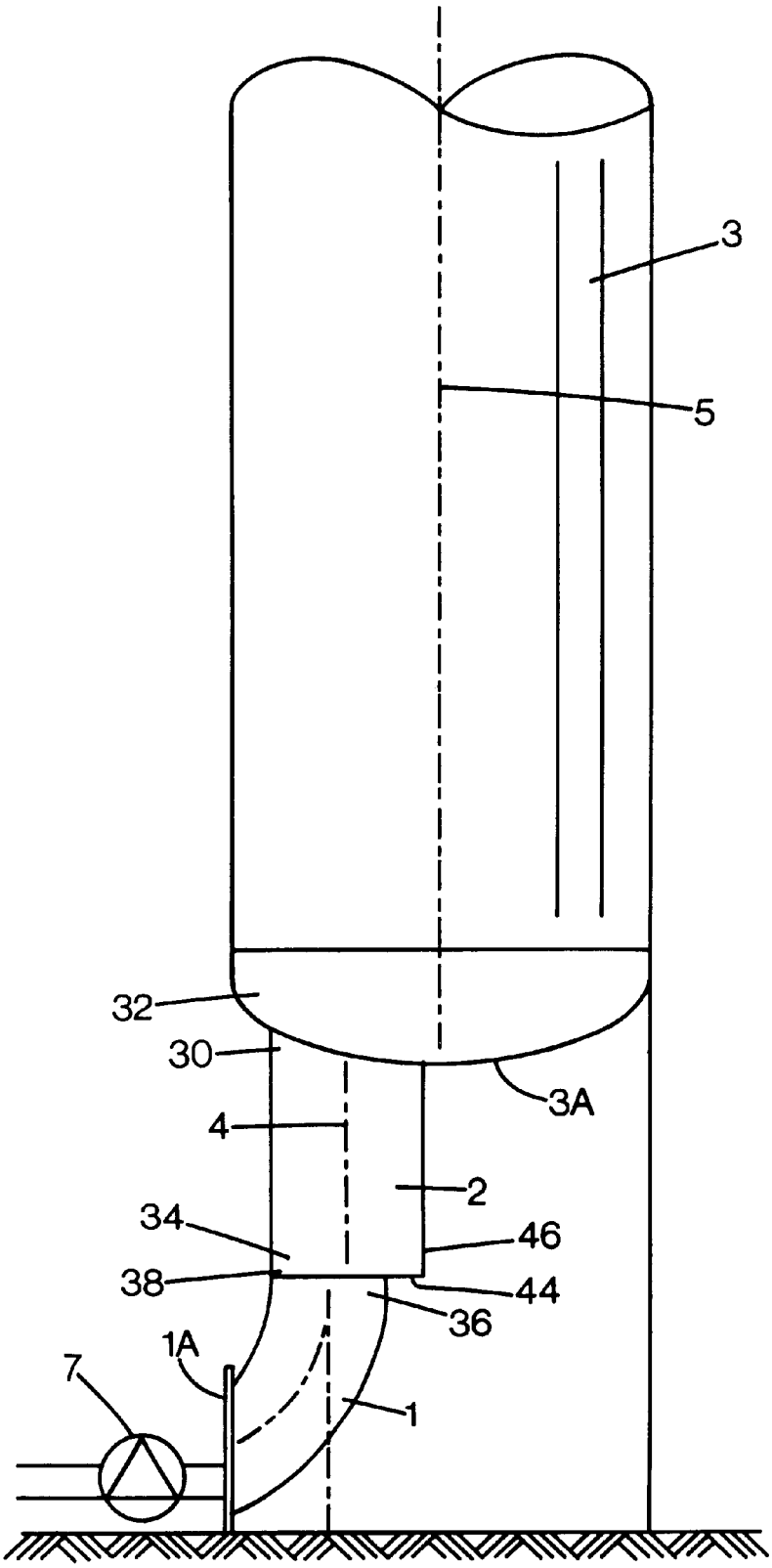
FIG. 3 shows a preferred embodiment of the invention mounted in conjunction with the pulp tower, and, FIGS. 4 and 5 show an alternative embodiment for mounting it to the pulp tower.

In FIG. 3 there is shown a preferred embodiment of the invention in conjunction with pulp storage tower 3. The pulp storage tower 3 is shown to be of a common design, having a cupped gable at the bottom 3. At the cupped gable 3A a drop leg 2 is attached thereto by welding. As can be seen the drop leg is not mounted centrally in relation to the pulp storage tower 3, but has its centre axes 4 positioned off-centred in relation to the central axis 5 of the pulp storage tower 3. At the bottom of the drop leg 2 there is attached a bow pipe 1 as shown in FIG. 1. A pump 7 is mounted at the vertical end 1A of the bow pipe 1. By mounting the drop leg 2 asymmetrically in relation to the pulp tower further positive effects are gained for avoiding bridges to be formed within the pulp tower, since its asymmetrically design reduces the risk of creating such bridges. Accordingly the design shown in FIG. 3 does provide for a more reliable design for pumping of pulp from the pulp storage tower 3 then prior art designs.

Figure 4:
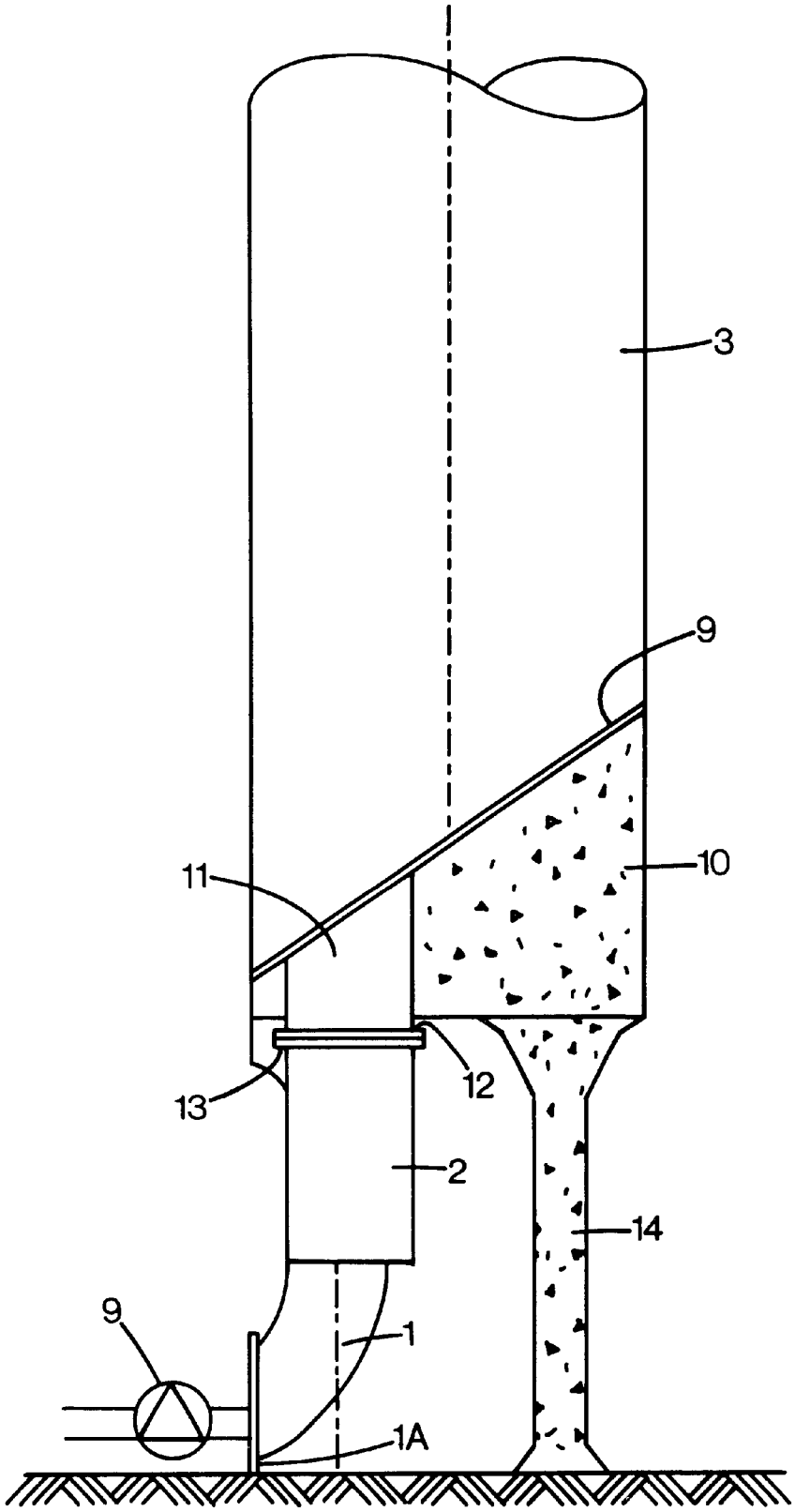

In FIG. 4 there is shown an alternative embodiment where pulp tower 3 is arranged with an inclined bottom 9. The inclined bottom 9 is made by means of using a concrete base portion 10. The pulp tower and also the bottom portion of the pulp tower has a circular cross-sectional configuration. At the lower end of the inclined bottom 9 there is arranged a through hole 11 having a flange 12 arranged at its lower end. The flange 12 is bolted to the upper flange 13 of the drop leg 2 and bow pipe unit 1 in accordance with the above. A pump 9 is mounted in the same manner as shown in FIG. 3. The pulp tower 3 rests on at least one concrete pillar 14 positioned below the highest part of the inclined bottom of the concrete portion. Also the drop leg and bow pipe 2, 1 does form a part of the support for the pulp tower, by means of the lower flange 1A being fixedly attached to the ground.

The invention is not limited by what is shown but can be varied within the scope of the claims. The skilled man realizes that in place of welding attachment means like bolts or any similar means may be used. Furthermore the skilled man realizes that other designs than cupped gables and also other materials than concrete for a bottom portion may be used in connection with the pulp tower for achieving the positive effect in relation to avoiding bridges. Also towers having a cross-sectional configuration, which is different from the circular configuration, (e.g. rectangular, octagonal) can be used in connection with the invention. In a preferred embodiment the inclined bottom may be arranged with a lining which reduces the friction of the bottom portion of the tower.

With reference to FIGS. 1, 3 the stand pipe 2 has a first end 30 attached to a bottom section 32 of the pulp storage tower 3 and a second end 34 attached to an upper end 36 of the pipe elbow 1 at an attachment point 38 between the second end 34 and the upper end 36. The stand pipe 2 has an inner diameter (d1) at or adjacent to the attachment point 38 that is greater than an inner diameter (d2) of the pipe elbow 1 at or adjacent to the attachment point 38. The pipe elbow 1 has an inner wall segment 40, at an internal curved portion 41 of the pipe elbow 1, that is flush or even with an inner wall segment 42 of the stand pipe 2 so that the transition from the stand pipe 2 to the pipe elbow 1 is smooth. In this way, the stand pipe 2 has a flange section 44, at the attachment point 38, extending from an external side 46 of the stand pipe 2 to an external side 47 of the pipe elbow 1, so that the pipe elbow 1 is tightly joined to the stand pipe 2.

Figure 5:
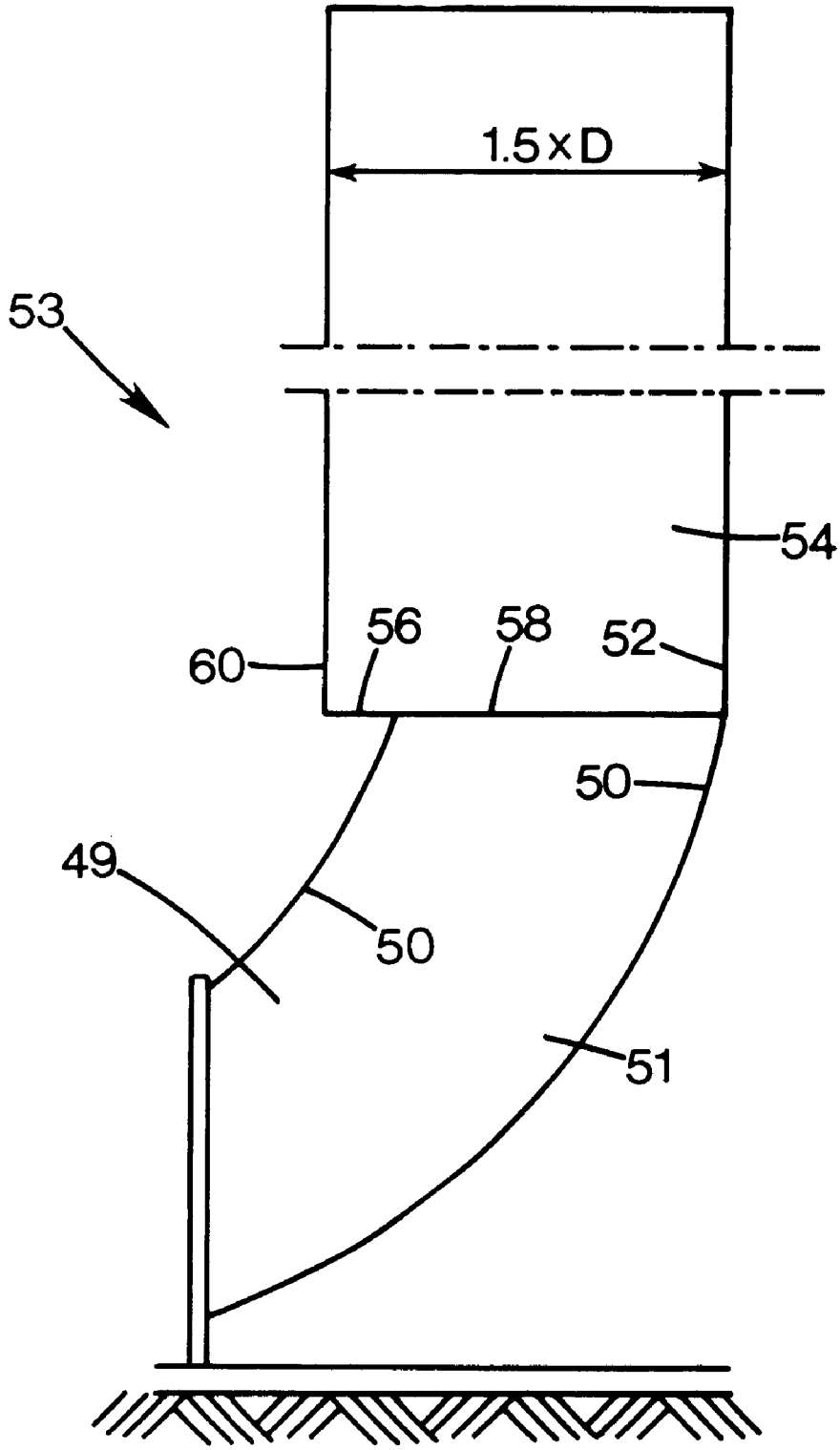

FIG. 5 shows an embodiment of a pipe attachment 53 of the present invention that is identical to the embodiment shown in FIGS. 1–4 except that a pipe elbow 49 has an inner wall segment 50, at an external curved portion 51 of the pipe elbow 48, that is flush or even with an inner wall segment 52 of a stand pipe 54 so that the transition from the stand pipe 54 to the pipe elbow 49 is smooth at the external curved portion 51 instead of at the internal curved portion. In this way, the stand pipe 54 has a flange section 56 at an attachment point 58, on an internal side 60 of the stand pipe 54, so that the pipe elbow 49 is tightly joined to the stand pipe 54.

While the present invention has been described in accordance with preferred compositions and embodiments, it is to be understood that certain substitutions and alterations may be made thereto without departing from the spirit and scope of the following claims.

What is claimed is:

1. A pipe attachment for discharging pulp to a pump, comprising:

a stand pipe having a first end attached to a bottom of a pulp storage tower and a second end attached to an upper end of a pipe elbow at an attachment point;

the pipe elbow being tightly joined to the second end of the stand pipe, the stand pipe being located above the pipe elbow, the stand pipe having an inner diameter at the attachment point that is greater than an inner diameter of the pipe elbow at the attachment point, the stand pipe having a first inner wall portion and the pipe elbow having a second inner wall portion being flush with the first inner wall portion at the attachment point; and a pump mounted to a lower end of the pipe elbow.

2. The pipe attachment according to claim 1 wherein the portion of the stand pipe coincides with an internal curved wall portion of the pipe elbow.

3. The pipe attachment according to claim 1 wherein the wall portion of the stand pipe coincides with an external curved wall portion of the pipe elbow.

4. The pipe attachment according to claim 1 wherein a diameter of the stand pipe is 1.5 times greater than a diameter of the pipe elbow.

5. The pipe attachment according to claim 1 wherein the pipe attachment is arranged at a bottom portion of a pulp tower, the pipe attachment has a pipe center line and the pulp tower has a tower center line, the pipe center line is off-centered the tower center line.

6. The pipe attachment according to claim 5 wherein the pulp tower has a diameter that is at least two times greater than a diameter of the stand pipe.

* * * * *

UNITED STATES PATENT AND TRADEMARK OFFICE

CERTIFICATE OF CORRECTION

PATENT NO. : 6,418,963 B1 
DATED : July 16, 2002
INVENTOR(S) : Rolf Ekholm and Ulf Jansson It is certified that error appears in the above-identified patent and that said Letters Patent is hereby corrected as shown below:

Title page,
Item [22], PCT Filed, delete "Jul. 21, 1999" and replace with -- Nov. 11, 1998 --.
Item [86], PCT No. : PCT/SE98/02029
§ 371 ( c)(1),
(2), (4) Date:, delete "Nov. 14, 1998" and replace with -- May 10, 2000 --.

Signed and Sealed this

Fifteenth Day of April, 2003

JAMES E. ROGAN
*Director of the United States Patent and Trademark Office*